US009838792B2

(12) United States Patent
Liu et al.

(10) Patent No.: US 9,838,792 B2
(45) Date of Patent: Dec. 5, 2017

(54) VIBRATION SYSTEM OF A LOUDSPEAKER

(71) Applicant: GOERTEK INC., WeiFang (CN)

(72) Inventors: Xuelu Liu, WeiFang (CN); Xinfeng Yang, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/915,169

(22) PCT Filed: Apr. 28, 2014

(86) PCT No.: PCT/CN2014/076368

§ 371 (c)(1),
(2) Date: Feb. 26, 2016

(87) PCT Pub. No.: WO2015/027715

PCT Pub. Date: Mar. 5, 2015

(65) Prior Publication Data

US 2016/0212541 A1 Jul. 21, 2016

(30) Foreign Application Priority Data

Aug. 27, 2013 (CN) ..... 2013 1 0382830

(51) Int. Cl.

| | |
|---|---|
| ***H04R 7/12*** | (2006.01) |
| ***H04R 9/06*** | (2006.01) |
| *H04R 7/18* | (2006.01) |

(52) U.S. Cl.

CPC ..... *H04R 7/125* (2013.01); *H04R 9/06* (2013.01); *H04R 7/18* (2013.01); *H04R 2307/025* (2013.01)

(58) Field of Classification Search

CPC .... H04R 7/125; H04R 9/06; H04R 2307/025; H04R 7/18

See application file for complete search history.

(56) References Cited

U.S. PATENT DOCUMENTS

2010/0288579 A1 11/2010 Gerkinsmeyer
2011/0317868 A1* 12/2011 Tsujii ..... H04R 7/16 381/400

(Continued)

FOREIGN PATENT DOCUMENTS

CN 101998208 A 3/2011
CN 202652511 U 1/2013

(Continued)

OTHER PUBLICATIONS

International Search Report for PCT/CN2014/076368 filed on Apr. 28, 2014.

(Continued)

*Primary Examiner* — Duc Nguyen
*Assistant Examiner* — Taunya McCarty

(57) ABSTRACT

The present invention discloses a vibration system of a loudspeaker, comprising a diaphragm and a voice coil attached to one side of the diaphragm, wherein the diaphragm comprises at least two layers of polyether-ether-ketone base films, and furthermore, the diaphragm comprises at least one layer of crystallized polyether-ether-ketone base film and at least one layer of non-crystallized polyether-ether-ketone base film. The diaphragm made of both crystallized and non-crystallized polyether-ether-ketone base films can have both an effectively improved acoustic performance and a lowered resonance frequency f0, thus, the acoustic effect of the loudspeaker can be improved.

19 Claims, 1 Drawing Sheet

(56) References Cited

U.S. PATENT DOCUMENTS

| | | | | |
|---|---|---|---|---|
| 2012/0325576 | A1 | 12/2012 | Taniguchi | |
| 2015/0125692 | A1* | 5/2015 | Mussig | H04R 7/10 428/339 |

FOREIGN PATENT DOCUMENTS

| | | | |
|---|---|---|---|
| CN | 103227972 | A | 7/2013 |
| CN | 103475981 | A | 12/2013 |
| CN | 203590434 | U | 5/2014 |
| JP | 2001-016683 | A | 1/2001 |
| KR | 10-2010-0042040 | A | 4/2010 |

OTHER PUBLICATIONS

Office Action from Korean Patent Office for Application No. 10-2016-7008053, dated Sep. 21, 2016.
Office Action from Chinese Patent Office for Application No. 201310382830.0, dated Dec. 2, 2015.

* cited by examiner

VIBRATION SYSTEM OF A LOUDSPEAKER

FIELD OF THE INVENTION

The present application is a National Stage of International Patent Application No. PCT/CN2014/076368, filed on Apr. 28, 2014, which claims priority to Chinese Patent Application No. 201310382830.0 filed on Aug. 27, 2013, the disclosures of which are incorporated herein by reference. The present invention relates to the field of electro-acoustic technology, and more specifically, to a vibration system of a loudspeaker.

BACKGROUND

A vibration system of a loudspeaker comprises a diaphragm and a voice coil attached to one side of the diaphragm. The diaphragm of a loudspeaker in the prior art may have a single layer structure or a multilayer composite structure, and the acoustic performance thereof may be adjusted accordingly where necessary. A higher requirement for a loudspeaker leads to a higher requirement for the performance of the diaphragm thereof, thus, a diaphragm material that may meet the requirement for a high acoustic performance diaphragm is needed.

As an improvement, a polyether-ether-ketone composite material is widely used for the diaphragm in the prior art. Furthermore, a crystallized polyether-ether-ketone material is preferably used for the diaphragm so as to ensure the reliability of the loudspeaker. However, the crystallized polyether-ether-ketone material cannot sufficiently meet the requirement for a higher acoustic performance diaphragm, although it can ensure the reliability of the diaphragm. In addition, the resonance frequency $f_0$ of the diaphragm made of the crystallized polyether-ether-ketone is too high to meet a technical requirement for a low resonance frequency $f_0$. Therefore, it is necessary to improve the diaphragm with the traditional structure as described above, so that the improved diaphragm may satisfy the demands for high acoustic performance and low resonance frequency $f_0$.

SUMMARY

As for the above problems, the object of the present invention is to provide a vibration system of a loudspeaker, wherein the diaphragm of the vibration system can have both a high acoustic performance and a low resonance frequency $f_0$, so that the acoustic effect of the loudspeaker can be improved.

In order to solve the above problems, the present invention provides a vibration system of a loudspeaker, comprising a diaphragm and a voice coil attached to one side of the diaphragm, wherein the diaphragm comprises at least two layers of polyether-ether-ketone base films, and furthermore, the diaphragm comprises at least one layer of crystallized polyether-ether-ketone base film and at least one layer of non-crystallized polyether-ether-ketone base film.

Preferably, two adjacent polyether-ether-ketone base films in the diaphragm may be combined together by using an adhesive layer or a poly urethane layer.

Preferably, one side of the diaphragm may be made of a layer of non-crystallized polyether-ether-ketone base film, to which the voice coil is attached.

Preferably, the crystallized polyether-ether-ketone base film may have a thickness in the range of 1-30 μm, and the non-crystallized polyether-ether-ketone base film may have a thickness in the range of 1-30 μm.

Preferably, the crystallized polyether-ether-ketone base film may have a thickness in the range of 5-8 μm.

Preferably, the crystallized polyether-ether-ketone base film may have a thickness in the range of 8-12 μm.

Preferably, the non-crystallized polyether-ether-ketone base film may have a thickness in the range of 3-9 μm.

Preferably, the non-crystallized polyether-ether-ketone base film may have a thickness in the range of 9-16 μm.

Preferably, the non-crystallized polyether-ether-ketone base film may have a thickness in the range of 16-30 μm.

Preferably, a fool-proofing mark may be disposed on the diaphragm to distinguish the front side from the back side of the diaphragm.

Preferably, the diaphragm may comprise two layers of crystallized polyether-ether-ketone base films and one layer of non-crystallized polyether-ether-ketone base film.

Preferably, the diaphragm may comprise two layers of non-crystallized polyether-ether-ketone base films and one layer of crystallized polyether-ether-ketone base film.

Compared with the traditional diaphragm structure, the diaphragm according to the present invention is made of crystallized and non-crystallized polyether-ether-ketone base films so that the diaphragm can have both an effectively improved acoustic performance and a lowered resonance frequency $f_0$, thus, the acoustic effect of the loudspeaker can be improved.

In order to achieve the above and related objects, one or more aspects of the present invention comprise the technical features described in details hereinafter and specifically indicated in claims. Some exemplified aspects of the present invention are elaborated in the following description and with reference to the drawings. However, the exemplified aspects of the present invention only show some of a variety of modes to apply the principle of the present invention. In addition, the present invention is intended to include all the aspects and their equivalents.

BRIEF DESCRIPTION OF THE DRAWINGS

These and other objectives and advantages of the present invention will be more readily apparent from the following detailed description with reference to the drawings and the contents of the claims. In the drawings:

Like reference numerals denote like or similar features or performances throughout the drawings.

DETAILED DESCRIPTION

The technical solution of the present invention will be clearly and completely described in the embodiments of the present invention and with reference to the drawings. Apparently, the described embodiments are only some, not all, of the embodiments of the present invention. In the following description of the embodiments, for the purpose of illustration, a lot of specific details are set forth in order to provide a thorough understanding of one or more aspects of the present invention. It may be evident, however, that such aspects may be practiced without these specific details. All other embodiments obtained by those skilled in the art on the basis of the embodiments of the present invention and without an inventive work involved fall within the scope of protection of the present invention.

Figure 1:
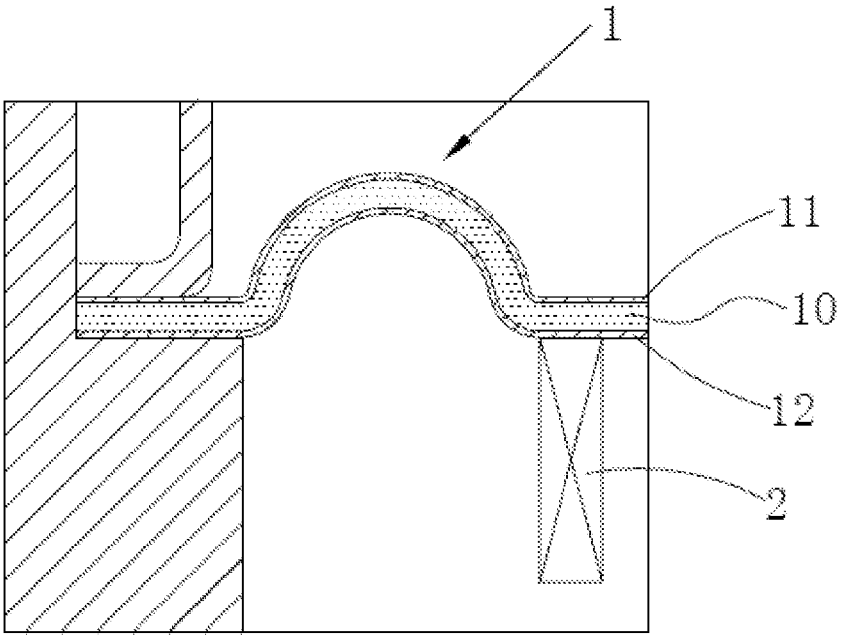
FIG. 1 is a sectional view showing the structure of the vibration system of the loudspeaker according to an embodiment of the present invention.

FIG. 1 is a sectional view showing the structure of the vibration system of the loudspeaker according to an embodiment of the present invention.

As shown in FIG. 1, the vibration system of the loudspeaker according to the present invention comprises the diaphragm 1 and the voice coil 2 attached to one side of the diaphragm 1. When an electrical signal is applied to the voice coil 2, it will vibrate up and down in the magnetic gap formed in the magnetic circuit system of the loudspeaker, and thus force the diaphragm to vibrate and produce a sound. Some characteristics of the diaphragm 1, such as rigidity, composition and so on, will have an influence on the effect of sound produced by the vibration of the diaphragm.

The diaphragm according to the present invention is made of at least two layers of polyether-ether-ketone (PEEK) base films. Polyether-ether-ketone has both rigidity and flexibility, and possesses a prominent anti-fatigue performance, a large tensile strength, and a good high/low temperature resistance. Therefore, polyether-ether-ketone can be used, due to the above characteristics thereof, to form a diaphragm so as to significantly improve the acoustic characteristics of the diaphragm.

Furthermore, polyether-ether-ketone has either a crystallized state or a non-crystallized state. The diaphragm according to the present embodiment is made of two states of polyether-ether-ketone, that is, the diaphragm according to the present embodiment comprises at least one layer of crystallized polyether-ether-ketone base film and at least one layer of non-crystallized polyether-ether-ketone base film.

Figure 2:
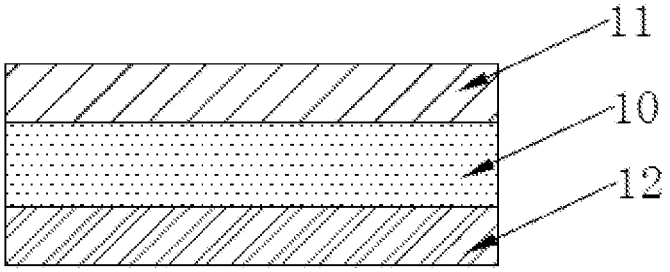
FIG. 2 is a sectional view showing the structure of the diaphragm according to the embodiment of the present invention.

FIG. 2 is a sectional view showing the structure of the diaphragm according to the embodiment of the present invention.

As shown in FIG. 2, the diaphragm according to the present embodiment comprises a layer of crystallized polyether-ether-ketone base film 11 and a layer of non-crystallized polyether-ether-ketone base film 12, which are combined together by an adhesive layer 10 in between. Preferably, the adhesive layer 10 may be an acrylic adhesive layer which has a good damping property.

It should be noted that the crystallized polyether-ether-ketone base film and the non-crystallized polyether-ether-ketone base film may also be combined by a poly urethane (PU) layer; the number of the crystallized and non-crystallized polyether-ether-ketone base films is not limited to two, as long as the diaphragm comprises both crystallized and non-crystallized polyether-ether-ketone.

A traditional diaphragm comprises either crystallized polyether-ether-ketone or non-crystallized polyether-ether-ketone. A diaphragm made of crystallized polyether-ether-ketone only has a too high resonance frequency $f_0$, although its acoustic performance can be guaranteed; meanwhile, a diaphragm made of non-crystallized polyether-ether-ketone only has a poor performance, although its resonance frequency $f_0$ may be low. The diaphragm according to the present embodiment is made of a crystallized polyether-ether-ketone base film 11 and a non-crystallized polyether-ether-ketone base film 12 combined together, thus, one the one hand, it may have a good acoustic performance due to the crystallized polyether-ether-ketone base film 11, and on the other hand, it may have a low resonance frequency $f_0$ due to the non-crystallized polyether-ether-ketone base film 12, so that the acoustic effect of the loudspeaker can be effectively improved.

Molecules of crystallized polyether-ether-ketone are regularly arranged, thus, a diaphragm made of crystallized polyether-ether-ketone may have a smooth surface, meanwhile, molecules of non-crystallized polyether-ether-ketone are irregularly arranged, thus, a diaphragm made of non-crystallized polyether-ether-ketone may have a rough surface. In a preferred embodiment of the present invention, the voice coil 2 is attached to the non-crystallized polyether-ether-ketone side of the diaphragm, as shown in FIG. 1, in order to increase the bonding strength between the diaphragm 1 and the voice coil 2. Since the non-crystallized polyether-ether-ketone base film 12 has a rough surface, into which the adhesive easily infiltrates, the bonding strength between the diaphragm 1 and the voice coil 2 can be improved, and thus, the stability and reliability of the loudspeaker can be accordingly improved, and a detachment between the diaphragm 1 and voice coil 2 during operation can be prevented.

Preferably, the crystallized polyether-ether-ketone base film 11 may have a thickness in the range of 1-30 μm, and the non-crystallized polyether-ether-ketone base film may also have a thickness in the range of 1-30 μm. The diaphragm made of the crystallized and non-crystallized polyether-ether-ketone base films with a thickness set in the above mentioned numeral range may have both a good acoustic performance and a low resonance frequency $f_0$.

Furthermore, preferably, the crystallized polyether-ether-ketone base film 11 may have a thickness in the range of 5-8 μm, or in the range of 8-12 μm when necessary. For example, the crystallized polyether-ether-ketone base film 11 may have a thickness of 6 μm, 8 μm, or 7 μm.

In addition, preferably, the non-crystallized polyether-ether-ketone base film 12 may have a thickness in the range of 3-9 μm, such as 4 μm, 5 μm, or 6 μm, or in the range of 9-16 μm, such as 10 μm, 12 μm, or in the range of 16-30 μm, such as 20 μm.

In a practical application, the thicknesses of the crystallized and non-crystallized polyether-ether-ketone base films may be selected according to the thickness of the adhesive layer. For example, the crystallized polyether-ether-ketone base film 11 may have a thickness of 8 μm, the adhesive layer may have a thickness of 20 μm, and the non-crystallized polyether-ether-ketone base film 12 may have a thickness of 12 μm, which will lead to a diaphragm with good acoustic performance and low resonance frequency $f_0$.

In addition, since one side of the diaphragm is made of a crystallized material, and the other side of the diaphragm is made of a non-crystallized material, it is necessary to dispose a fool-proofing mark on the diaphragm to distinguish the front side from the back side of the diaphragm, so as to identify the crystallized side and the non-crystallized side of the diaphragm, and prevent an error from occurring during diaphragm forming and the following process (for example, when the voice coil is combined with the diaphragm). The fool-proofing mark can be disposed in any manner, for example, by using a color pen.

The present invention may have other modifications in addition to the above described embodiment. For example, the number of the polyether-ether-ketone base films composing the diaphragm may be more than two. In case that the diaphragm is made of three layers of polyether-ether-ketone base films, the base films can be arranged in the following order: crystallized PEEK/crystallized PEEK/non-crystallized PEEK, non-crystallized PEEK/crystallized PEEK/non-crystallized PEEK, crystallized PEEK/non-crystallized PEEK/crystallized PEEK, non-crystallized PEEK/non-crystallized PEEK/crystallized PEEK, wherein PEEK stands for polyether-ether-ketone. Any two adjacent polyether-ether-ketone base films in the diaphragm can be combined together by using an adhesive layer or a poly urethane layer. The above modifications may also lead to a diaphragm with good acoustic performance and low resonance frequency $f_0$.

The vibration system of the loudspeaker according to the present invention has been disclosed in an exemplified way with reference to the drawings. Various modifications to the disclosure will be readily apparent to those skilled in the art, and the generic principles defined herein may be applied to other variations without departing from the spirit or scope of the disclosure. Thus, the disclosure is not intended to be limited to examples described herein but is to be accorded the widest scope consistent with the principles and novel features disclosed herein.

The invention claimed is:

1. A vibration system of a loudspeaker, comprising a polyether-ether-ketone diaphragm and a voice coil attached to one side of the diaphragm, wherein the diaphragm comprises at least two layers of polyether-ether-ketone base films, and is characterized in that the diaphragm comprises at least one layer of crystallized polyether-ether-ketone base film and at least one layer of non-crystallized polyether-ether-ketone base film, wherein two adjacent polyether-ether-ketone base films in the diaphragm are combined together by using an adhesive layer or a polyurethane layer, and wherein one side of the diaphragm is made of a layer of non-crystallized polyether-ether-ketone base film, to which the voice coil is attached, wherein a thickness of the non-crystallized polyether-ether-ketone base film is greater than a thickness of the crystalized polyether-ether-ketone base film, and wherein the thickness of the crystallized polyether-ether-ketone base film and the non-crystallized polyether-ether-ketone base film are selected according to the thickness of the adhesive layer such that the diaphragm has good acoustic performance from the crystallized polyether-ether-ketone base film and lower resonance frequency from the non-crystallized polyether-ether-ketone base film, thereby improving acoustic effects of the diaphragm.

2. The vibration system of a loudspeaker according to claim 1, characterized in that the at least one layer of crystallized polyether-ether-ketone base film has a thickness in the range of 1 μm to 30 μm, and the at least one layer of non-crystallized polyether-ether-ketone base film has a thickness in the range of 1 μm to 30 μm.

3. The vibration system of a loudspeaker according to claim 2, characterized in that the at least one layer of crystallized polyether-ether-ketone base film has a thickness in the range of 5 μm to 8 μm.

4. The vibration system of a loudspeaker according to claim 2, characterized in that the at least one layer of crystallized polyether-ether-ketone base film has a thickness in the range of 8 μm to 12 μm.

5. The vibration system of a loudspeaker according to claim 2, characterized in that the at least one layer of non-crystallized polyether-ether-ketone base film has a thickness in the range of 3 μm to 9 μm.

6. The vibration system of a loudspeaker according to claim 2, characterized in that the at least one layer of non-crystallized polyether-ether-ketone base film has a thickness in the range of 9 μm to 16 μm.

7. The vibration system of a loudspeaker according to claim 2, characterized in that the at least one layer of non-crystallized polyether-ether-ketone base film has a thickness in the range of 16 μm to 30 μm.

8. The vibration system of a loudspeaker according to claim 2, characterized in that a mark is disposed on the diaphragm to distinguish a front side from a back side of the diaphragm.

9. The vibration system of a loudspeaker according to claim 2, characterized in that the diaphragm comprises two layers of crystallized polyether-ether-ketone base films and one layer of non-crystallized polyether-ether-ketone base film.

10. The vibration system of a loudspeaker according to claim 1, characterized in that the diaphragm comprises two layers of non-crystallized polyether-ether-ketone base films and one layer of crystallized polyether-ether-ketone base film.

11. The vibration system of a loudspeaker according to claim 1, characterized in that the at least one layer of crystallized polyether-ether-ketone base film has a thickness in the range of 1 μm to 30 μm, and the at least one layer of non-crystallized polyether-ether-ketone base film has a thickness in the range of 1 μm to 30 μm.

12. The vibration system of a loudspeaker according to claim 11, characterized in that the at least one layer of crystallized polyether-ether-ketone base film has a thickness in the range of 5 μm to 8 μm, or 8 μm to 12 μm.

13. The vibration system of a loudspeaker according to claim 11, characterized in that the at least one layer of non-crystallized polyether-ether-ketone base film has a thickness in the range of 3 μm to 9 μm, or 9 μm to 16 μm, or 16 μm to 30 μm.

14. The vibration system of a loudspeaker according to claim 1, characterized in that the at least one layer of crystallized polyether-ether-ketone base film has a thickness in the range of 1 μm to 30 μm, and the at least one layer of non-crystallized polyether-ether-ketone base film has a thickness in the range of 1 μm to 30 μm.

15. The vibration system of a loudspeaker according to claim 14, characterized in that the at least one layer of crystallized polyether-ether-ketone base film has a thickness in the range of 5 μm to 8 μm, or 8 μm to 12 μm.

16. The vibration system of a loudspeaker according to claim 14, characterized in that the at least one layer of non-crystallized polyether-ether-ketone base film has a thickness in the range of 3 μm to 9 μm, or 9 μm to 16 μm, or 16 μm to 30 μm.

17. The vibration system of a loudspeaker according to claim 1, characterized in that the diaphragm comprises two layers of non-crystallized polyether-ether-ketone base films and one layer of crystallized polyether-ether-ketone base film.

18. A method for manufacturing a vibration system of a loudspeaker, wherein the vibration system of a loudspeaker comprises a polyether-ether-ketone diaphragm and a voice coil attached to one side of the diaphragm, and the diaphragm comprises at least one layer of crystallized polyether-ether-ketone base film and at least one layer of non-crystallized polyether-ether-ketone base film, the method comprising:

attaching the voice coil to a side of the diaphragm on which a layer of the non-crystallized polyether-ether-ketone base film is disposed, wherein a thickness of the non-crystallized polyether-ether-ketone base film is greater than a thickness of the crystalized polyether-ether-ketone base film, and wherein the thickness of the crystallized polyether-ether-ketone base film and the non-crystallized polyether-ether-ketone base film are selected according to the thickness of the adhesive layer such that the diaphragm has good acoustic performance from the crystallized polyether-ether-ketone base film and lower resonance frequency from the non-crystallized polyether-ether-ketone base film, thereby improving acoustic effects of the diaphragm.

19. The method for manufacturing a vibration system of a loudspeaker according to claim 18, further comprising:

disposing a mark on the diaphragm to distinguish a front side from a back side of the diaphragm, before attaching the voice coil to the one side of the diaphragm.

* * * * *